United States Patent [19]

Wielonski et al.

[11] Patent Number: 4,704,299

[45] Date of Patent: Nov. 3, 1987

[54] PROCESS FOR LOW TEMPERATURE CURING OF SOL-GEL THIN FILMS

[75] Inventors: Roy F. Wielonski; Peter J. Melling, both of Worthington, Ohio

[73] Assignee: Battelle Memorial Institute, Columbus, Ohio

[21] Appl. No.: 795,393

[22] Filed: Nov. 6, 1985

[51] Int. Cl.[4] ..... B05D 3/06

[52] U.S. Cl. ..... 427/38; 427/397.7; 501/12

[58] Field of Search ..... 427/38, 39, 41, 397.7; 204/164; 501/7, 12, 80

[56] References Cited

U.S. PATENT DOCUMENTS

| | | | |
|---|---|---|---|
| 3,759,683 | 9/1973 | Dislich et al. | 501/7 |
| 3,770,499 | 10/1973 | Crowe et al. | 427/38 |
| 4,168,330 | 9/1979 | Kaganowkz | 427/39 |
| 4,282,268 | 8/1981 | Priestley | 427/39 |
| 4,297,246 | 10/1981 | Cairns et al. | 427/397.7 |
| 4,361,598 | 11/1982 | Yoldas | 427/397.7 |
| 4,420,517 | 12/1983 | Ali | 427/397.7 |
| 4,435,476 | 3/1984 | Phillips et al. | 427/39 |
| 4,472,512 | 9/1984 | Lane et al. | 501/80 |
| 4,521,441 | 6/1985 | Flowers | 427/38 |

FOREIGN PATENT DOCUMENTS

| | | | |
|---|---|---|---|
| 56-078434 | 6/1981 | Japan | 501/12 |

*Primary Examiner*—John H. Newsome
*Attorney, Agent, or Firm*—Klaus H. Wiesmann

[57] ABSTRACT

A process for curing and densifying a sol-gel derived inorganic thin film at lower temperatures (between 10° C. and 400° C.) by applying the films to a substrate, drying the film at a low temperature, exposing the film to a low pressure plasma. The film may be an oxide (e.g. $SiO_2$), nitride (e.g. $Si_3N_4$), oxynitride (e.g. $SiO_xN_y$) or sulfide (e.g. $GeS_2$).

4 Claims, 1 Drawing Figure

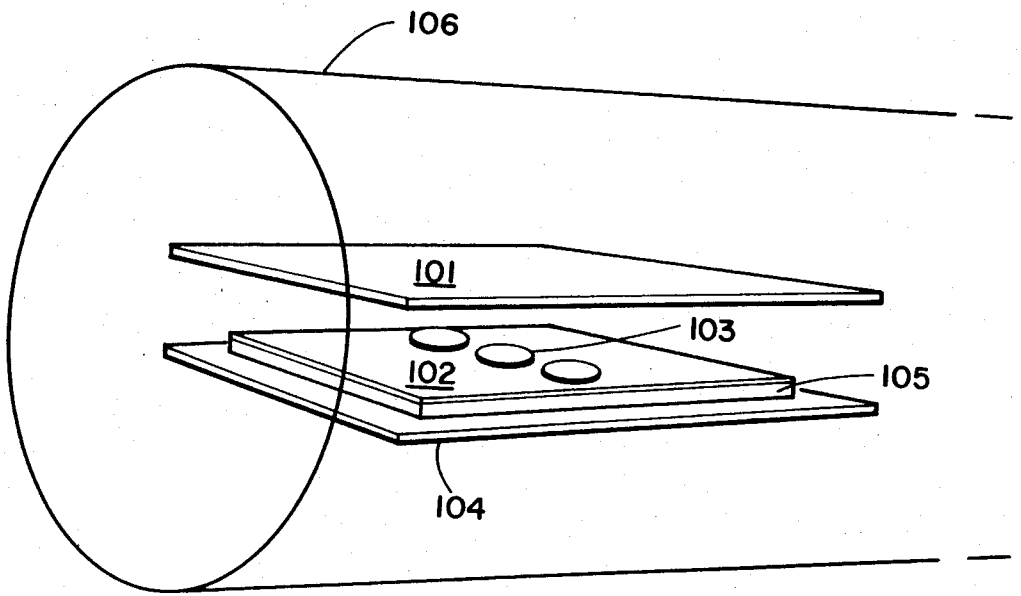
106
101
103
102
105
104

PROCESS FOR LOW TEMPERATURE CURING OF SOL-GEL THIN FILMS

FIELD OF THE INVENTION

This invention relates to a method for curing and densifying sol-gel derived inorganic thin films and coatings at temperatures considerably lower than those required using the conventional technique of heating in a furnace, and also to the incorporation in those thin films and coatings of anionic dopants from the treatment atmosphere. More specifically, it relates to the use of a low pressure plasma to cure and densify sol-gel thin films at low temperatures.

BACKGROUND OF THE INVENTION

The specification of U.S. Pat. No. 3,759,683 describes a "Process for the Manufacture of Multi-Component Substances" for the preparation of oxide glasses and ceramics. This process is an example of what is commonly known as the sol-gel process. In the conventional sol-gel process an alcoholic solution of a metal alkoxide or mixture of metal alkoxides is hydrolyzed under controlled conditions to form a sol which may be molded or used as a coating then cured to form a gel. Depending upon the application, a coating may be applied by dipping, spin coating, or any other suitable technique. Subsequently drying and heat treatment is then required to form a densified coating or monolith. While the treatment temperatures necessary are substantially below those required by conventional sintering or melt processing the temperatures needed are still substantially greater than can be withstood by many substrates. Thus there are considerable advantages to be obtained if sol-gel thin films and coatings can be cured to high density at temperatures approaching ambient. Sol-gel thin films have potential as diffusion and oxidation barriers, dielectric films, and scratch-resistant coatings. For microelectronic applications, sol-gel derived silicon dioxide and silicon-oxynitride thin films are attractive for passivation coatings, interlayer dielectrics and field and gate oxides, particularly for III-V semiconductors such as Ga-As. Developments in this area have been impeded however, because the temperatures required to densify the sol-gel are too high to maintain the integrity of the substrate in many situations. A low-temperature curing process would also offer advantages where it is desired to coat metals with a low melting temperature such as aluminum where the melting temperature of the metal is below that required to densify materials such as silicon dioxide.

Low pressure gas discharges or plasmas are known to effect changes in materials which normally occur only at high temperatures, this is because the molecules and atoms in the gas become excited and attain high energies in the electric discharge. When the atoms and molecules come into contact with a solid surface the result can be to activate the surface.

Other related U.S. Pat. Nos. include: 4,521,441 by Flowers where a film on a semiconductor substrate is treated in a plasma environment with about 10% oxygen (oxygen plasma). The film is a dopant material, including a glass former and a suitable solvent. The plasma treatment temperature is 150° C.–400° C. while the diffusion temperature is 850° C.–1200° C.; 4,472,512 to Lane shows a process for removing retained water in a sol-gel process by contacting the material with a gas and an organic compound; 4,429,051 to Davidge discloses a high temperature process for heating a sol-gel material and is only of general interest; 4,220,461 to Samanta shows a low temperature process for depositing a glass film by diffusion through a barrier between a first and second solution however final consolidation is done at a high temperature (about 1450° C.) to form a consolidated nonporous glass; 4,170,663 to Hahn et al reveals a process in which a hard, mar-resistant, abrasive resistant coating is cured by ionizing radiation in an atmosphere containing a cure inhibiting amount of oxygen, in additicnal stages it is exposed to ultraviolet light and ionizing radiation; and finally 4,125,644 to Ketley et al discloses a process in which a protective coating is provided to a fiber optic material, subsequently exposing the material to ionizing radiation or ultraviolet radiation to cure the coating. The protective coating is a photopolymer.

It is therefore, the object of this invention to provide a method of curing and densifying sol-gel thin films at significantly lower temperatures than are possible using known techniques.

It is another object of the invention to provide a method of doping sol-gel thin films with foreign anions under the low temperature curing conditions.

BRIEF SUMMARY OF THE INVENTION

The foregoing and other advantages are achieved in the present invention through the use of a low temperature plasma curing and densifying process. A sol-gel coating material is applied to the surface of a substrate to form a thin film. The film is then preferably allowed to dry under ambient conditions before being placed in a chamber and subjected to a low pressure plasma.

BRIEF DESCRIPTION OF THE DRAWING

The drawing illustrates in semi-schematic form the arrangement used for treating the samples in the method of the invention.

DETAILED DESCRIPTION OF THE PREFERRED EMBODIMENTS

In this process a substrate or article to be coated is preferably first cleaned to remove contaminants then coated with a sol of suitable composition. The sol may have a composition as described in U.S. Pat. No. 3,759,683 or may be of a similar chemical nature, for instance a single-component silicon dioxide sol formed by the acid or base catalyzed hydrolysis of tetraethoxysilane in alcohol solution. If a nonoxide material is desired a sol formed by similar chemistry to that of the oxide case, such as has been reported for germanium sulfide may be used. "Alternative Methods of Preparing Chalcogenide Glasses", P. J. Melling, Ceramic Bulletin, Vol. 63, No. 11, pp. 1427–9, 1984.

Further examples of oxide sol-gel films useful in the invention include $SiO_2$, $A1_2O_3$, $TiO_2$, PbO, $La_2O_3$, $ZrO_2$, $BaTiO_3$ and mixtures thereof. Examples of oxynitride films include $SiO_xNy$, $AlO_xN_y$, and mixtures thereof. In the latter two formulas subscripts x and y have been used as the oxygen and nitrogen content will vary with conditions employed in sol-gel formation and plasma curing. The plasma may be used, as illustrated in Example 2, to incorporate another ion (nitrogen or others such as phosphorus or the like) into the sol-gel material being treated. Examples of sulfide sol-gel films useful in the invention include $TiS_2$, $GeS_2$ and mixtures thereof.

Application of the coating should be by a technique such as spinning, dipping, or other similar technique such as spray or roller coating to give a thin uniform coating of preferably less than 10 microns. The preferred conditions are a temperature between 10° C. and 100° C. (although up to 150° C. is acceptable) and a time between 1 hour and 20 days. The optimum drying conditions will vary depending upon the chemical composition and properties of the sol. It will also be necessary to control the humidity of the drying atmosphere for highly reactive oxide sols. The coated object should then be transferred to the plasma chamber and the chamber atmosphere flushed with the desired gas.

For oxide materials pure oxygen is the preferred gas or, if a nitride or oxynitride is required, nitrogen or ammonia gas may be used. Noble gases such as argon may be mixed with these gases. For sulfides, hydrogen sulfide is a reasonable choice and for phosphides, phosphine. Similarly, other gases could be chosen for other materials. The chamber should be maintained at a pressure between 1.3 Pascals (Pa) and 30 Pa and a power level between 0.3 $KW/m^2$ and 5 $KW/m^2$ is preferred. To obtain a full cure the time required will depend upon the coating composition and the coating thickness. The sol applied will contain residual organics and unreacted groups. The residual organics are removed by the low pressure and the unreacted groups undergo further reaction with the plasma to cure and densify the product film.

EXAMPLE 1

Two three-inch diameter silicon wafers polished on one side were cleaned by washing and degreasing in an organic solvent and then allowed to dry. Subsequent handling was carried out with gloved hands or clean tools to avoid contamination of the surface.

A silicon dioxide sol was prepared by mixing 15 ml of tetraethoxysilane with 50 ml of ethyl alcohol and subsequently mixing the combined solution with a combined solution of 85 ml of ethyl alcohol and 2.4 ml of distilled water. Two drops of concentrated nitric acid were then added with vigorous stirring and the sol allowed to age overnight. This sol was then used for subsequent coatings.

The silicon wafers were placed in a spin coater, polished side up and flooded with a sol. The spinner was then turned on at a fixed speed. One sample, sample 1, was spun at 500 rpm for 30 seconds and the other, sample 2, at 1000 rpm for 60 seconds.

Both samples were allowed to dry under ambient conditions for 10 days. They were then placed in a plasma reactor FIG. 1 and subjected to a plasma treatment for 30 minutes. The plasma gas was pure oxygen, the pressure during the run was 6 Pa and the plasma source operated at 400 Watts and 130 KHz. During the treatment the substrate temperature did not exceed 50° C. The samples were then removed and the refractive index and thickness were determined by elipsometry. The thickness of the film on sample 1 was 3045 angstroms and the refractive index was 1.4. The thickness of the film on sample 2 was 2800 angstroms and the refractive index was 1.46. This compares with a theoretical refractive index of 1.53 at the wavelength used for measurement. If the refractive index of the voids in the coating is assumed to be 1.0 then the coating of sample 1 is 75 percent dense and the coating of sample 2 is 87 percent dense. This difference is to be expected and confirms that the plasma treatment is having a densifying effect. This is because sample 2 was prepared as a thinner coating and the interaction with the plasma is expected to be greater because of this.

A simple side by side abrasion test between a plasma cured wafer, sample 1, and an uncured coated wafer showed a significant increase in abrasion resistance for the plasma cured sample.

EXAMPLE 2

Two silicon wafers were prepared by the method described in Example 1 and coated with a sol prepared the same way and with the same solids loading as in Example 1. One, sample 3, was spun at 1000 rpm for 120 seconds and the other, sample 4, for 35 seconds at 1000 rpm. Both samples were allowed to dry under ambient conditions for 10 days then subjected to a plasma treatment in a nitrogen plasma at a pressure of 5.1 Pa for 30 minutes at a power of 400 Watts. The temperature again did not exceed 50° C.

The refractive index of sample 3 was 2.38 and the thickness 1427 angstroms. For sample 4 the thickness was 2000 angstroms and the refractive index 1.88. These results are indicative of extensive nitridation to form a silicon oxynitride thin film. To confirm that nitridation has occurred the coatings were examined by x-ray photoelectron spectroscopy using a Leybold Heraeus LHS10 spectrometer and standard data reduction techniques. A ratio of 0.88 nitrogen atoms per oxygen atom was found for sample 3 and a ratio of 0.59 nitrogen atoms per oxygen atom was found for sample 4. This demonstrates that nitridation does occur in the nitrogen plasma and the differences in the degree of nitridation can be understood in terms of the thickness of the coatings.

The nitrogen gas in this example is acting as a dopant gas material. The extent of doping may be extensive as in this example or only to a small degree. The method is the same as for the previous examples except that the dopant gas is selected in pure form (as in Example 2) or mixed with a another gas (e.g. oxygen, noble gases).

EXAMPLE 3

A germanium sulfide coating is cured by taking a germanium sulfide sol (prepared by the reaction of tetraethoxygermane with hydrogen sulfide or a base such as tetraethylammoniumhydrogensulfide in a solvent such as carbon-disulfide) and spin coating it into a cleaned germanium substrate. The substrate is then dried under an inert or hydrogen sulfide containing atmosphere for 2 days then placed in the plasma chamber taking care to avoid contact with ambient air. The sample is then subjected to a hydrogen sulfide plasma for 120 minutes to form a densified germanium sulfide coating.

Further description of the invention may be had by reference to the drawing. The plasma discharge equipment may be typical equipment used for providing plasma discharges. The drawing shows the arrangement used for the specific examples. Two 16" electrodes 101,102 were placed in facing parallel positions about 3" apart and the samples 103 placed between them on the lower electrode 102. The lower electrode 102 was supported on a ground plane 104 by a teflon insulator 105. The whole unit is placed in a vacuum chamber 106 and connected to a power supply (not shown) by leads (also not shown). The gel coating of the samples 103 is cured by a combination of several components of the plasma namely gaseous ion impingement (e.g. oxygen ion, nitrogen ion, or sulfide ion) ultraviolet radiation (produced by the discharge) and vacuum desorption of volatile material. For example residual solvent and alcohol that are generated by the polymerization reaction.

The above examples serve to illustrate the general outlines of the invention. It should be noted that a variety of oxide, nitride, oxynitride, sulfide and phosphide sol-gel films may be used as well as a number of gases for the plasma, the optional gases being easily determined by those skilled in the art and knowing the teachings of the invention.

The general overall process of the invention can be described as a process for producing a cured and densified thin film by coating a substrate with a plasma curable and densifiable film. The film is then exposed to a low pressure curing and densifying plasma. Film composition, gas for plasma formation, power levels, pressure, temperature and times are selected, as outlined above, to be adapted to impart curing and densifying properties to the film.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

We claim:

1. A process for producing a cured and densified thin film comprising:

a. coating a substrate with a plasma curable and densifiable film;

b. drying the film at ambient temperature; and c. exposing the film to an atmosphere containing a curing and densifying plasma at a low pressure, at a power level, at a temperature below 400° C., and for a time adapted to impart curing and densifying properties to the film;

wherein the plasma curable and densifiable film is selected from the group consisting of:

a. the oxides of silicon, aluminum, titanium, lead, lanthanum, zirconium, barium titanate and mixtures thereof where the plasma is formed from oxygen or nitrogen;

b. the oxynitrides of silicon and aluminum and mixtures thereof where the plasma is formed from nitrogen; and c. the sulfides of titanium and germanium and mixtures thereof where the plasma is formed from $H_2S$.

2. The process of claim 1, further comprising exposing the film wherein:

a. the low pressure is about 1.3 Pa to about 30 Pa; and b. the power level is about 0.3 $KW/m^2$ to about 5 $KW/m^2$.

3. The process of claim 1 further comprising exposing the film to the plasma at a low temperature below about 150° C.

4. The process of claim 1 wherein the atmosphere containing a curing and densifying plasma further comprises a gas containing a dopant gas material.

* * * * *